US007980014B2

(12) United States Patent
Fasbender

(10) Patent No.: US 7,980,014 B2
(45) **Date of Patent: *Jul. 19, 2011**

(54) THREE DIMENSIONAL TAB SYSTEM

(75) Inventor: David Fasbender, Hastings, MN (US)

(73) Assignee: Smead Manufacturing Company, Hastings, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/428,665

(22) Filed: Apr. 23, 2009

(65) Prior Publication Data

US 2009/0205231 A1 Aug. 20, 2009

Related U.S. Application Data

(63) Continuation of application No. 11/724,550, filed on Mar. 15, 2007, now Pat. No. 7,536,812.

(60) Provisional application No. 60/782,454, filed on Mar. 15, 2006.

(51) Int. Cl.
*B42F 21/00* (2006.01)

(52) U.S. Cl. ..... 40/359; 40/360; 40/641

(58) Field of Classification Search ..... None
See application file for complete search history.

(56) References Cited

U.S. PATENT DOCUMENTS

| | | | |
|---|---|---|---|
| 1,115,216 | A | 10/1914 | Laviolette |
| 1,308,471 | A | 7/1919 | Barker |
| 2,039,752 | A | 5/1936 | Frederick |
| 3,966,113 | A | 6/1976 | Tipton |
| 4,014,434 | A | 3/1977 | Thyen |
| 4,617,223 | A | 10/1986 | Hiscock et al. |
| 4,910,066 | A | 3/1990 | Foisie |
| 5,174,606 | A | 12/1992 | Hure |
| 5,966,852 | A | 10/1999 | Drzewiecki |
| 6,209,778 | B1 | 4/2001 | Henrikson et al. |
| D450,091 | S | 11/2001 | Henrikson et al. |
| 6,385,860 | B1 | 5/2002 | MacWilliams et al. |
| 6,453,589 | B1 | 9/2002 | Schwartz |
| 6,764,101 | B2 | 7/2004 | MacWilliams et al. |
| 2001/0021339 | A1 | 9/2001 | Pacione |
| 2002/0050711 | A1 | 5/2002 | MacWilliams et al. |
| 2002/0089171 | A1 | 7/2002 | Silvestre |
| 2004/0051296 | A1 | 3/2004 | MacWilliams et al. |
| 2004/0195821 | A1 | 10/2004 | Ghent |
| 2005/0022718 | A1 | 2/2005 | Weisenfeld |
| 2005/0022719 | A1 | 2/2005 | Weisenfeld |

*Primary Examiner* — Joanne Silbermann
*Assistant Examiner* — Christopher E Veraa
(74) *Attorney, Agent, or Firm* — Altera Law Gorup, LLC

(57) ABSTRACT

A system for a 3-D tab for a folder, a retrofit for existing folders to have a 3-D tab and a method of making same is disclosed. The 3-D tab is created by an extension or attachable element which can be folded onto itself so that one edge surface is at an angle relative to the panels of the file folder allowing it to be read from the side. This also aids in allowing the tab to be fed through a printer.

11 Claims, 7 Drawing Sheets

THREE DIMENSIONAL TAB SYSTEM

CROSS REFERENCE TO RELATED APPLICATION

This application is a continuation of application Ser. No. 11/724,550, filed 15 Mar. 2007, now U.S. Pat. No. 7,536,812. The application is incorporated herein by reference.

The present application claims the benefit of U.S. Provisional Application Ser. No. 60/782,454 filed on 15 Mar. 2006, the complete subject matter of which is hereby incorporated herein by reference in its entirety.

FIELD OF THE INVENTION

The present invention is directed to a system for marking the edges of folders or file folder-like products, and more particularly with top or end tabs.

BACKGROUND

File folders and other paper storage systems are of great utility in an office setting. The most common storage system, the common manila folder, for example are widespread and relatively inexpensive, and have convenient tabs suitable for writing. Typically tabbing systems are on the top or side of the file folder. Such system requires the user to have visual access to the tab at roughly a perpendicular/right angle relative to the folder. Otherwise the tab is invisible (i.e. only the thickness of the tab is visible, not the indicia (writing) on the tab itself, and thus the purpose of the tab is lost).

Another problem with tabs is that they need some sort of indicia imprinted thereon. Handwriting is the simplest solution but considered hard to read. Therefore imprinting is the preferred method. Because file folders are large format, they are difficult to run thru a printer, or at least a special printer is required. If the tab is not flat, then the option of running it thru a printer at all is pretty much out of the question.

So a solution needs to be found to provide a simple way to imprint a tab on a folder without having to run the entire folder thru a printer and also to provide a tab which is not flat and can be viewed at various angles.

There are other issues relevant to the solution of the present invention and they are detailed below.

BRIEF SUMMARY

The present invention has many facets and only a few are set forth in this summary. Reference should be had to the detailed description and the claims for a full definition of the invention.

One aspect of the invention includes a tab for a file folder or a folder itself having a) at least one panel surface having an edge, b) a portion of the edge including an extension, said extension having a substantially rigid section bounded by a pair of parallel fold lines, said fold lines being parallel to said edge, c) a portion extending from one of said parallel fold lines; so that when said extension is folded along said fold lines, and said portion is affixed to said panel surface, a 3 dimension tab is formed.

According to another aspect of the invention the folder's substantially rigid section includes a rigidifier, and the rigidifier may be a reinforcement strip applied to said rigid section or impregnation of the strip with a rigidifying material.

According to another aspect of the invention, a three-dimensional tab attachable to a file folder having at least one panel and having an edge has a) an attachment section for affixation to said panel; b) a semi rigid section connected to said attachment member having a pair of parallel fold lines on either side of thereof; c) a second attachment section extending from said rigid section at one of said fold lines; said second attachment member be affixable to said panel; so that when said second attachment member is folded onto said panel and fixed thereto, a three-dimensional tab is formed extending from said file folder.

According to another aspect of the invention there is a method of making a retrofit for a file folder to create a three dimensional tab system using the steps of a) providing a separate extension piece to be attached to an edge of the folder, b) scoring the piece with two parallel scores, the space between the scores constituting one face of the tab; c) rigidifying the space between said scores, either by reinforcement or by the geometry of the fold lines which create rigidity; d) applying adhesive to portion of the extension on either side of the scores adjacent said space; so that when said extension piece is folded along said scores, a 3-dimensional tab is formed and is adhesively attachable to said folder.

According to another aspect of the invention there is a method making a machine printable retrofit for a file folder to create a three dimensional tab system having a) providing a planar sheet of material; b) die cutting the sheet with the outline of a plurality of tab extension units, each including: providing a separate extension piece to be attached to an edge of the folder, scoring the piece with two parallel scores, the space between the scores constituting one face of the tab; applying adhesive to a portion of the extension on either side of the scores adjacent said space; so that when said extension piece is folded along said scores, a 3-dimensional tab is formed and is adhesively attachable to said folder. This invention creates a printable sheet with removable tab units.

This summary is not intended to be a complete review of all aspects of the invention disclosed herein. Reference needs to be had to the specification in total and the claims.

DETAILED DESCRIPTION OF THE INVENTION

Figure 1:
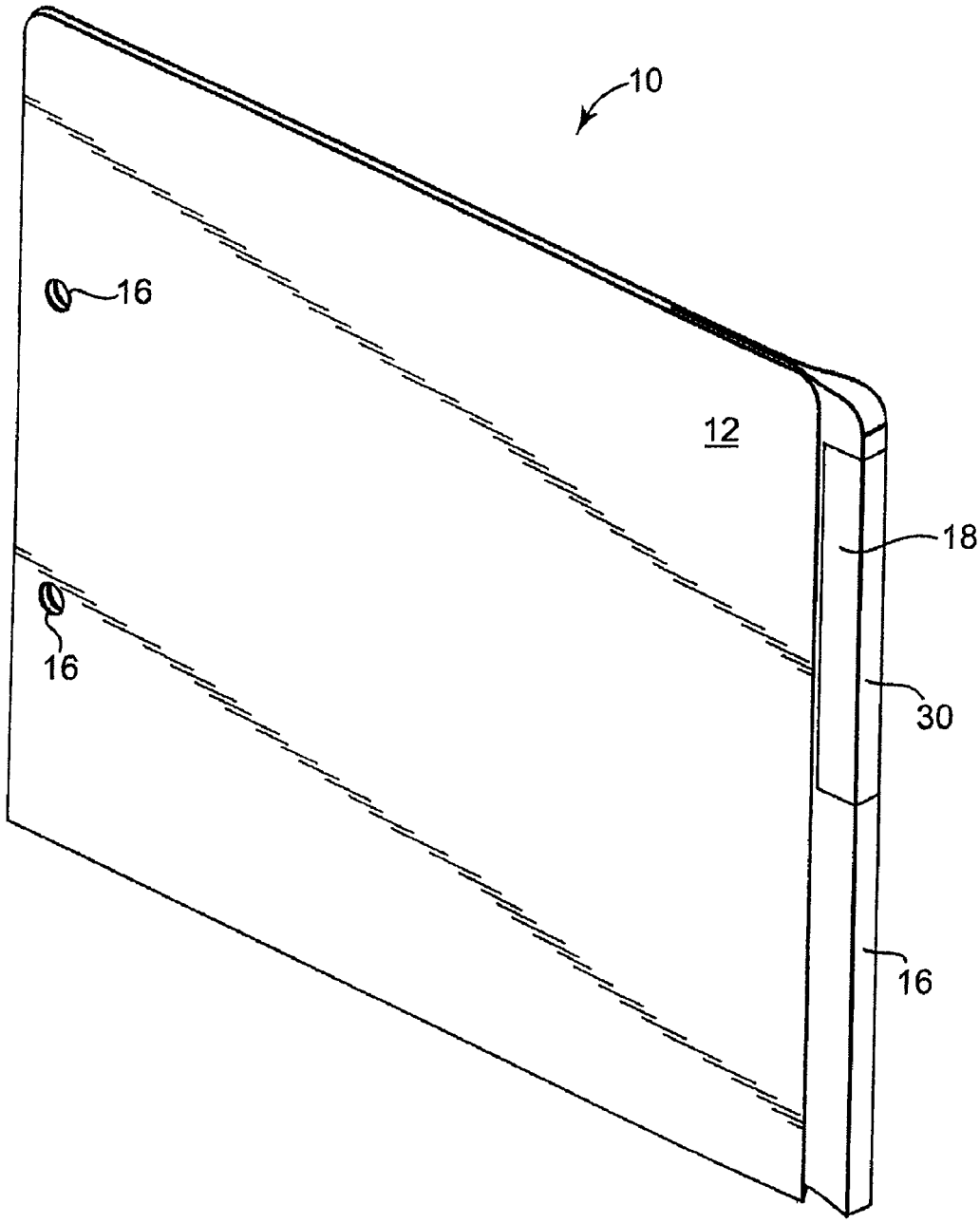
FIG. 1 is a perspective view of a folder with a unitary 3-D end tab attached.

The present invention is directed to a three dimensional tab system for use on file folders. The term file folder is intended to encompass a range of other office requisites, such as binders, folios, clip boards, pockets and similar items, so long as tabs may be used thereon. The ability to have a range of colors or textures (or other treatment aspects, or surface attribute) despite material limitations is an issue in many office products and this inventive solution applies. The invention is disclosed to several embodiments, for example, a unitary folder (taken broadly) with a 3 dimensional tab, or a multi-part embodiment, where the tab structure can be affixed to a folder (taken broadly). The later embodiment is particularly attractive to use when imprinting of the tab without the need for the entire folder having to run thru a printer.

For the sake of brevity, the embodiments in FIGS. 1-4 and 5-9 will be discussed simultaneously and the same reference numerals will be used whenever the elements are the same or similar.

Figure 5:
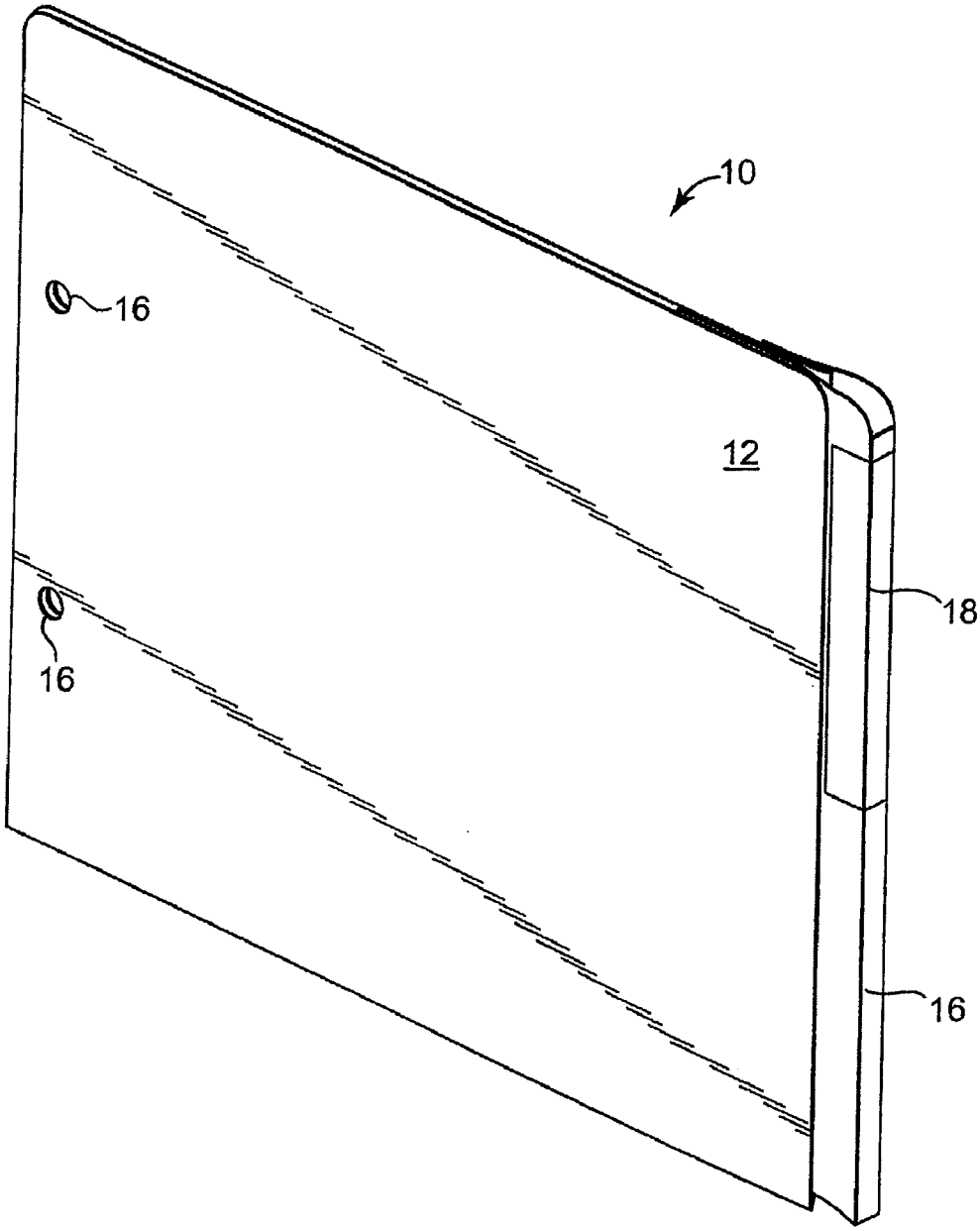
FIG. 5 is a perspective view like FIG. 1 but of a multi-part embodiment.

FIGS. 1 and 5 show an embodiment of an exemplary folder 10 having two planar panels 12 and 14. Holes 16 may be provided for papers clasps. The 3 dimensional end tab section 16 is shown with an optional label 18 affixed thereon.

Figure 6:
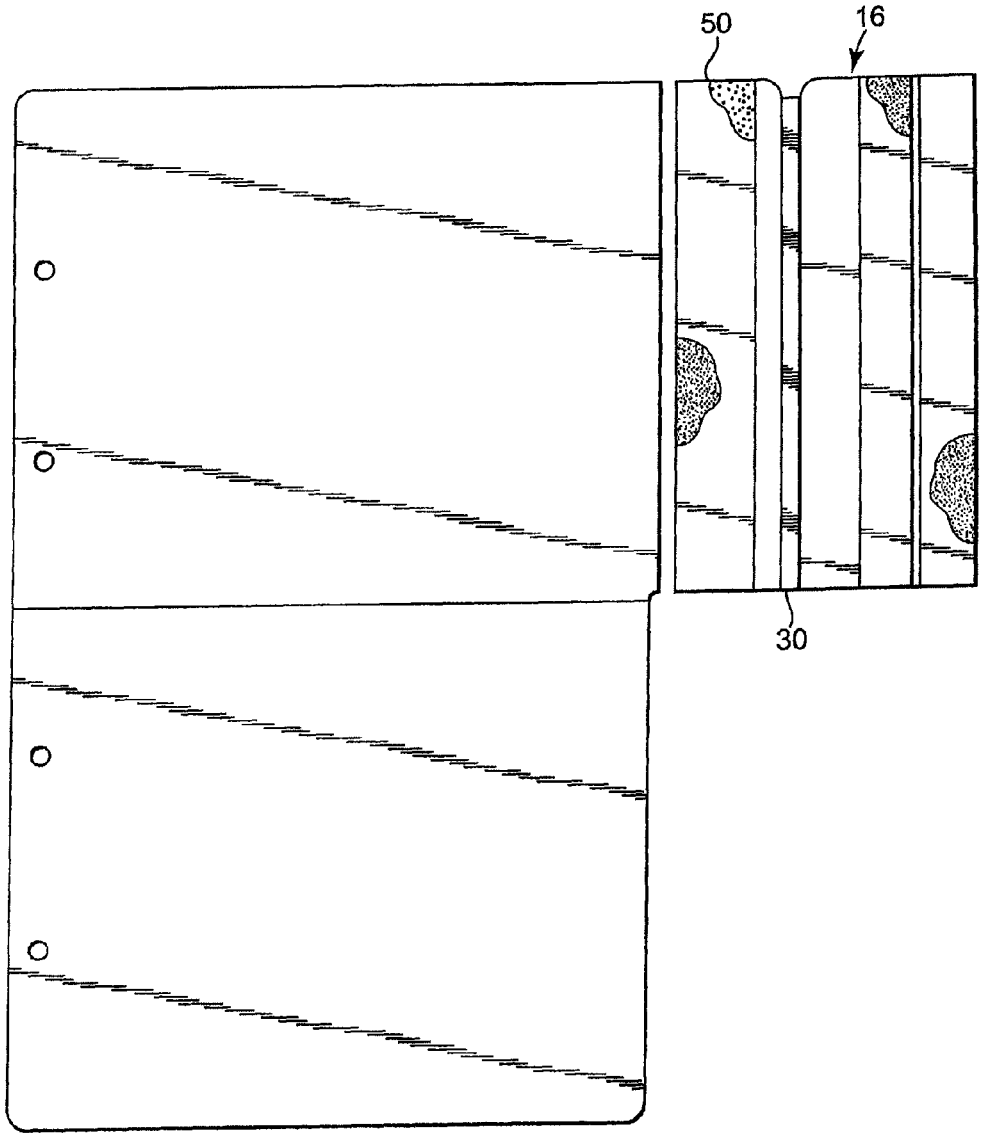
FIG. 6 is a view like FIG. 2 but of a multi-part embodiment.

In this example, panel 14 has a tab extension 20 integral to the folder. This extension is optional as will be explained below. It could also be a top tab instead of a side tab. FIG. 6 illustrates a version without the extension, though it is useable in that embodiment also. It is a separate unit which can be provided separately as and addition to any existing file folder.

As a separate unit, such as shown in FIG. 6, there are many ways to manufacture this item. The preferred mode is to cut the shown shape from a sheet of paper or cardboard like material. Because imprinting of indicia (writing on the tab) may be desired, such a version can be supplied on a planar sheet with multiple units laid out on a single sheet and die cut or kiss cut for easy removal. The advantage of this arrangement is that the sheet can be printed, much like labels, and then punched out (or peeled off, in the case of a kiss-cut). The preferred material in this configuration is a plastic which is sufficiently rigid to remain in the 3-D configuration when folded. It may not require a rigidifier.

In the integral version of this invention (FIGS. 1-5), tab section 16 is a rectangular element with several subsections and fold lines. The first section is a substantially rigid strip 30 having fold lines 32, 34 on both sides thereof. This rigid section forms the upper edge of the 3-dimensional tab as seen in FIGS. 1 and 3. In the preferred embodiment, it is made of a card stock material similar to the folder itself, but backed by a rigidifying strip, such as a plastic inlay or overlay. A rigidifier is any form of reinforcement which will tend to make the strip less likely to flex. It includes a plastic inlay affixed on what becomes the inner surfaces, so that when the tab is fully constructed, the rigidifying strip will be out of sight. It may also include a double layer of material, an overlay of material, impregnating the material with a chemical, plastic, phenol, etc. or any other means to achieve this objective. It also includes folding the material so that the sidewalls themselves make the strip more rigid.

The next tab section 40 extends from fold line 34 and may have an adhesive on its inner surface. An optional first section 40 is separated from a successive section 42 by a fold line, or crease 44, followed by a further option section 46 separated by fold line or crease 48. Any or all of the section may have adhesive or have removable strips covering adhesive. Note that adhesive is meant to be interpreted broadly as being any attachment means, including mechanical (pins, fasteners, staples, etc), welds, Velcro®, etc.

Figure 4:
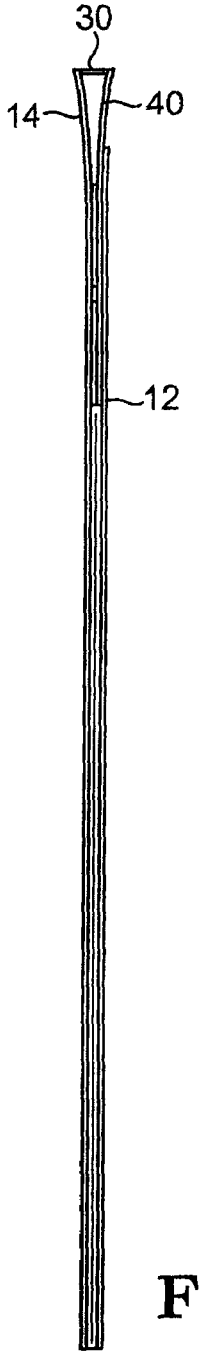
FIG. 4 is a side view of a unitary tab folder after assembly.

When folded as shown in FIGS. 1 and 4, a three dimensional tab is constructed. Notice that portions 40 and 44 are capable of being viewed from an angle parallel with the panels 12 and 14 whereas the tab portion 30 is roughly perpendicular (or other selected angle), or "generally L-shaped" with respect to panel 14. The exact angle depends on user preference, the length of the various panels or the affixation point of panels 40, 44 or 46 on panel 14. Further down the length of panel 14 panels 40, 44, 46 are affixed, the more acute the angle of the panel 30 will be. An obtuse angle for panel 30 is likewise achievable by opposite placement. For example, the angle between portions 40 and 30 is determined by point at which elements 40, 44 and 46 are affixed to the inside of panel 14. Further, by selective affixation of the various portions the angle of the label can be adjusted to any angel desired from 0-180 degrees. Perpendicular is most common, but a 45 degree angle could be useful for top tab folder viewed from a file drawer.

In the preferred embodiment, the optional panels 44 and 46 have adhesive which, by removing a protective strip, is adhered to panel 14 at a point where portion 30 is substantially perpendicular to panel 14. Crease 48 provides for a change in slope between portion 44 and 46 (portion 46 being substantially flush with panel 14 and panel 44 sloping away therefrom). Panel 40 will have the greatest slope (see FIG. 4).

It is not essential that panels 44 and 46 and creases 42 and 48 be provided. It is simply possible to fold the device along fold lines 32 and 34 and affixing panel 40 or at least a portion thereof, to the inside of panel 14. This may put more stress on the adhesive holding panel 40, but if properly compensated, a 3-D end tab is still achieved. FIG. 3 shows the direction of folding by arrow 60. Adhesive strips 62, 64 are also shown.

The important point is that a flat section can be made into a three dimensional tab. Because it is flat, it can be sent thru a printer so indicia can be printed on the various faces of the tab.

FIG. 5-9 are similar to the previous embodiments, except that this embodiment is not unitary (multi-part) attachable tab. The entire three dimensional tab section 16 is separable or separate from the folder itself. This has the distinct advantage that the tab section is small enough to run thru most ordinary printers for imprinting indicia thereon. Furthermore, ordinary folders (and other items with a panel to which the tab section can be attached) can be retrofitted to have this 3-D feature.

Figure 2:
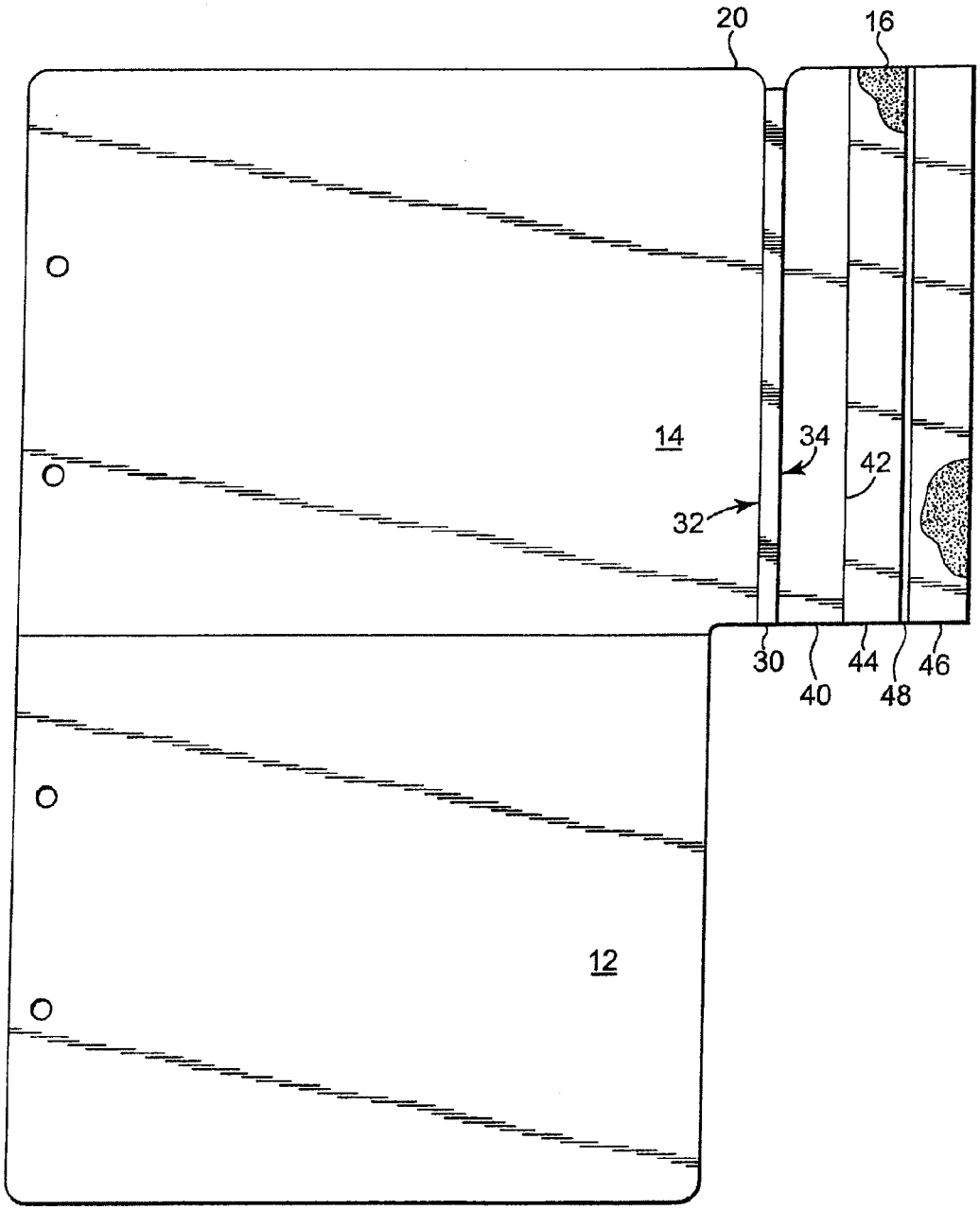
FIG. 2 is a plan view of a folder with 3-D tab attached.
Figure 3:
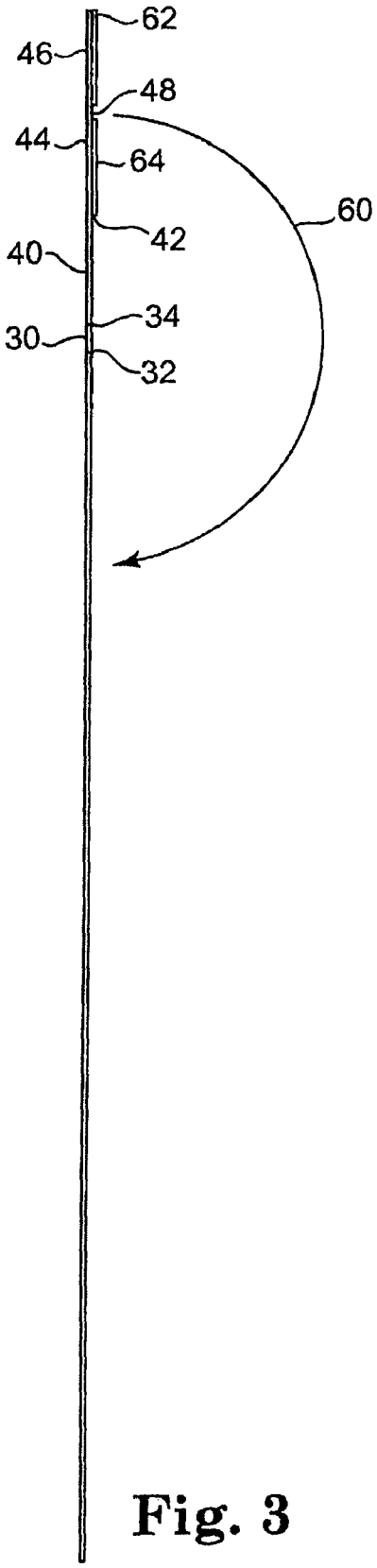
FIG. 3 is a side view of a unitary tab folder before assembly.
Figure 7:
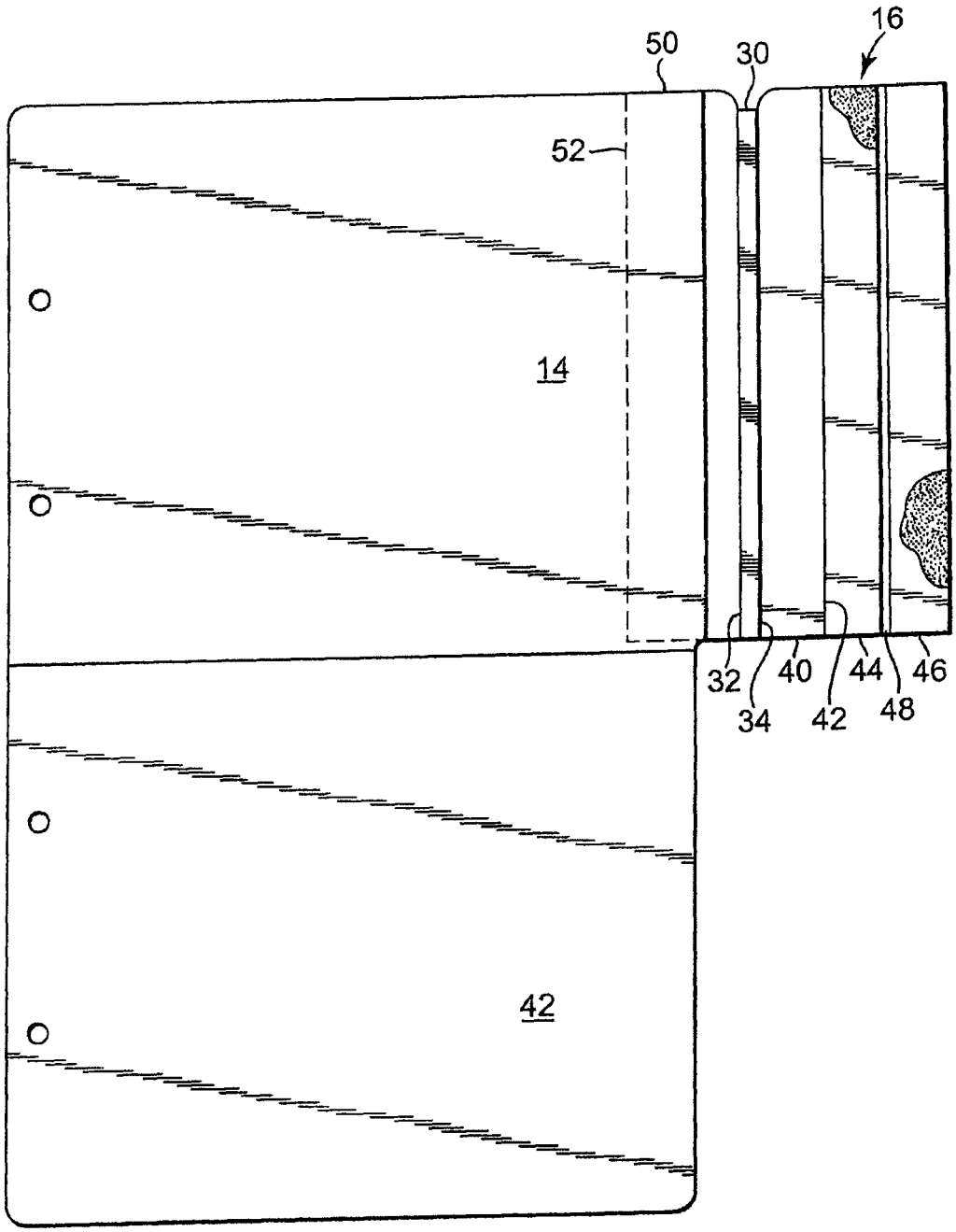
FIG. 7 is a view like FIG. 6 but with the parts attached.

This version differs in that optional portion 20 in FIG. 2 is replaced with an attachable backing portion 50 which is attached to panel 14. It is preferably attached to the outer surface, by putting adhesive on the outer surface of panel 50 (the portion not visible in FIG. 6). Alternatively, it can be affixed to the outer surface of panel 14 as shown in FIG. 7 in dotted lines 52. Notice that the folder in FIGS. 2 and 7 are different, in that the folder in FIG. 2 has a flat tab extension which is utilized in that embodiment. That integral extension is not needed as the 3-D tab section can provide for it.

Figure 8:
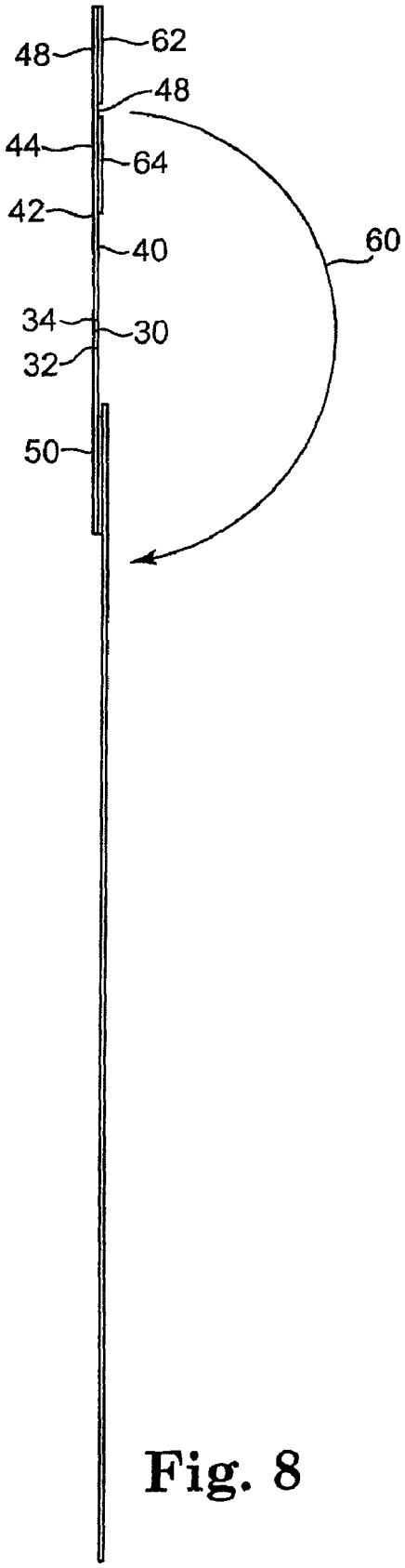
FIG. 8 is a view like FIG. 3 except with a multipart embodiment.
Figure 9:
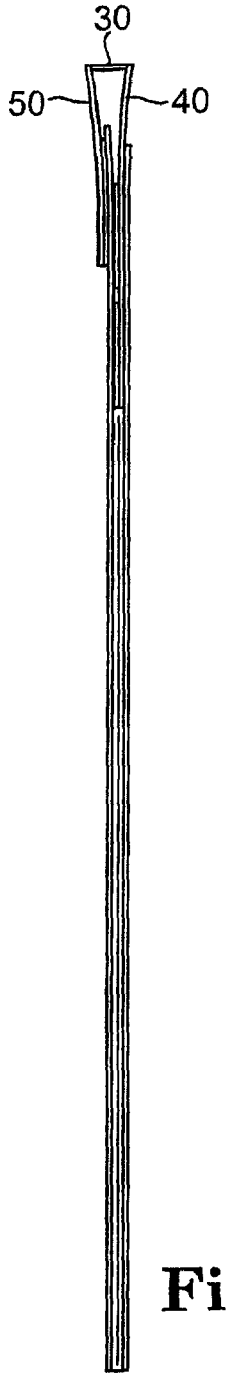
FIG. 9 is a view like FIG. 4, except with a multipart embodiment.

FIGS. 8 and 9 show the assembly of this separate/retrofit solution. Notice that portion 50 is shown on the outside surface of the folder, but it could also be reversed to the inside surface.

Notice that the unitary tab embodiment of FIG. 6-9 is capable of being put thru a printer because it is largely flat. The rigidifier, in such case should be made a flat as possible. One solution is a thin overlay, others are impregnation with a liquid which hardens the paper, using stiff materials, such as plastics in place of paper, and relying on the fold lines to create sufficient rigidity.

A method of making a file folder to have a 3 dimensional tab system is also disclosed. In one embodiment the method includes providing (or cutting a folder face having) an extension piece 16 extending from an edge of the folder, folding the piece into a triangular shape and affixed the free end of the triangle to the folder, thereby creating a surface which is generally perpendicular (or other selected angle) to the surface of the folder.

Another method is disclosed of retrofitting a file folder to have a 3 dimensional tab system. In one embodiment the method includes providing (or cutting a folder face having) a separate extension piece 16 to be attached to an edge of the folder, folding the piece into a triangular shape and affixed the free end of the triangle to the folder, thereby creating a surface which is generally perpendicular (or other shape by selecting the affixation point on the folder) to the surface of the folder.

As mentioned above, one method of making the detached, unitary add on tab shown in FIG. 6 is to provide a layout of a sheet of such tabs units which can be run thru a printer and by software the individual tabs units can be made be separately addressed for printing with multiple passes of the sheet thru the printer. The die-cut version allows for relatively thick materials to be used as no backing sheet is required.

The description of the invention including its applications and advantages as set forth herein is illustrative and is not intended to limit the scope of the invention, which is set forth in the claims. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A substantially planar machine printable file folder, including a tab extension being selectively adjustable into a 3 dimensional tab having a selectively adjustable viewing angle, said tab comprising:

a) at least one panel surface having an edge, b) a first portion of the edge including an extension, said extension having a plurality of transverse parallel fold lines, and at least one top section formed between a pair of parallel fold lines, c) a portion extending from on of said parallel fold lines further including a selectively adjustable affixation capable of being affixed on said panel surface at a user selectable location to create a tab with a display angle of 0-180 degrees according to user demand;

so that when said extension is folded along said fold lines, and said extending portion is affixed to said panel surface, a 3 dimension tab is formed.

2. The folder of claim 1 wherein said top section is a substantially rigid section and includes a rigidifier backing strip which is applied to the tab material.

3. The folder of claim 2 wherein the rigidifier is a reinforcement strip applied to said rigid section.

4. The folder of claim 2 wherein the rigidifier includes impregnation of the strip with a rigidifying material.

5. A substantially flat printable tab foldable into a triangular three-dimensional tab attachable to a file folder said file folder having at least one panel and having an edge said tab comprising:

a) an attachment section for affixation to said panel forming a first section of a triangular tab;

b) a semi rigid section connected to said attachment member having a pair of parallel fold lines on either side of thereof said semi rigid section forming the top of the triangle when said tab is folded;

c) a second attachment section extending from said rigid section at one of said fold lines; said second attachment member be affixable to said panel and forming another side of the triangular tab;

d) said second section including an removable affixator capable of being affixed on one side of said panel surface at a user selectable location to create a tab with a display angle of 0-180 degrees according to user demand and reaffix at another angle of choice to change the display angle at any time, so that when said second attachment member is folded onto said panel and fixed thereto, a three-dimensional tab is formed extending from said file folder.

6. The folder of claim 5 wherein said semi rigid section includes a rigidifier.

7. The folder of claim 6 wherein the rigidifier is a reinforcement strip applied to said rigid section.

8. The folder of claim 6 wherein the removable affixator is a hook and loop bond.

9. A method making a retrofit for a file folder to create a three dimensional tab system having a user adjustable tab display angle, comprising:

a) providing a separate extension piece to be attached to an edge of the folder, b) scoring the piece with two parallel scores, the space between the scores constituting one face of the tab;

c) applying a hook and loop adhesive to portion of the extension on either side of the scores adjacent said space said affixation capable of being affixed on said panel surface at a user selectable location to create a tab which has a user selectable display angle of 1-180 degrees;

so that when said extension piece is folded along said scores, a 3-dimensional tab is formed and is adhesively attachable to said folder.

10. The method of claim 9 wherein the rigidifying step includes the step of applying a rigid member to the space.

11. The method of claim 9 wherein the rigidifying step includes the step of impregnating the space with fluid which hardens.

* * * * *